US007024830B2

(12) United States Patent
Schiedegger et al.

(10) Patent No.: US 7,024,830 B2
(45) **Date of Patent: *Apr. 11, 2006**

(54) PLASTIC WINDOW ASSEMBLY

(75) Inventors: Charles E Schiedegger, Metamora, MI (US); Clyde G. Allen, North Branch, MI (US); John R. Tesluk, Metamora, MI (US)

(73) Assignee: Tapco International Corporation, Plymouth, MI (US)

( * ) Notice: Subject to any disclaimer, the term of this patent is extended or adjusted under 35 U.S.C. 154(b) by 178 days.

This patent is subject to a terminal disclaimer.

(21) Appl. No.: 10/368,677

(22) Filed: Feb. 18, 2003

(65) Prior Publication Data

US 2003/0213190 A1 Nov. 20, 2003

Related U.S. Application Data

(63) Continuation of application No. 09/724,093, filed on Nov. 28, 2000, now Pat. No. 6,604,333.

(51) Int. Cl.
*E06B 3/66* (2006.01)
*E06B 3/68* (2006.01)

(52) U.S. Cl. ..... 52/204.61; 52/204.54; 52/456; 52/663; 52/786.11; 52/786.13; 52/314; 49/50

(58) Field of Classification Search ..... 52/86, 52/85, 82, 213, 217, 208, 204.53, 204.56, 52/456, 786.1, 786.13, 211; 16/82, 85, 8.52, 16/86

See application file for complete search history.

(56) References Cited

U.S. PATENT DOCUMENTS

D77,738 S * 2/1929 Bricker
3,381,431 A * 5/1968 Jacobson ..... 52/309.1
3,686,814 A * 8/1972 Anderson ..... 52/456
4,057,945 A * 11/1977 Kessler ..... 52/204.593

(Continued)

FOREIGN PATENT DOCUMENTS

CA 2354474 A1 * 2/2002

OTHER PUBLICATIONS

Sweets 2003 Architects, Engineers &Contractors Edition, McGraw Hill Construction, vol. 6, J. Sussman, Inc. p. 7.*

(Continued)

*Primary Examiner*—Robert Canfield
(74) *Attorney, Agent, or Firm*—Howard & Howard

(57) ABSTRACT

A plastic window assembly is adapted to be mounted in an opening defined by a structure. The plastic window assembly is oval-shaped with a decorative plastic window muntin. A plastic frame supports parallel window panes. The window muntin is disposed between the parallel window panes. Flat surfaces of the window muntin have a first edge and a second edge and include a ridge disposed along each of the edges. Marring of the window panes is prevented because the ridge provides for line contact between the window muntin and the window panes. The window muntin may also be integrally molded to a plastic pane disposed between the parallel panes of glass. The plastic pane includes a surface texture that simulates frosted glass. The plastic window assembly includes a plurality of liner panels that extend through the opening from an interior of the structure. The window assembly includes a flange having aperture through-which fasteners are inserted to secure the window assembly to the structure. An exterior trim ring attaches to the outside of the window assembly and over siding on the structure. An interior trim ring attaches to a flange in the liner panel to give a finished appearance. All exposed surfaces include a surface texture that simulates wood grain.

14 Claims, 8 Drawing Sheets

U.S. PATENT DOCUMENTS 4,113,905 A * 9/1978 Kessler ..... 428/34
4,222,213 A * 9/1980 Kessler ..... 52/786.13
4,563,846 A 1/1986 Webb ..... 52/208
4,649,685 A * 3/1987 Wolf et al. ..... 52/204.593
4,780,998 A 11/1988 Knapp ..... 52/211
4,875,317 A 10/1989 Logan et al. ..... 52/208
4,970,840 A * 11/1990 Ouellette et al. ..... 52/204.61
5,099,626 A * 3/1992 Seeger ..... 52/314
5,274,976 A * 1/1994 Burkhart ..... 52/456
5,345,743 A * 9/1994 Baier ..... 52/455
5,351,459 A * 10/1994 Kassl et al. ..... 52/656.5
5,471,803 A * 12/1995 Logan et al. ..... 52/212
5,491,936 A * 2/1996 Logan et al. ..... 52/105
5,765,325 A * 6/1998 DeBlock ..... 52/204.5
5,899,033 A * 5/1999 Merchlewitz ..... 52/204.61
6,138,433 A * 10/2000 Ridge ..... 52/786.11
6,250,027 B1 * 6/2001 Richards ..... 52/204.59
6,272,801 B1 * 8/2001 Suh ..... 52/211
6,289,641 B1 9/2001 McCandless ..... 52/172
6,415,579 B1 * 7/2002 Reeder et al. ..... 52/786.13
6,735,922 B1 * 5/2004 Paffen ..... 52/786.1

OTHER PUBLICATIONS

Merriam-Webster's Collegiate Dictionary, 1999, 10, 1092.*
Sweet's General Building & Renovation, 1995, McGraw-Hill, Inc., 8, 1-6.
Merriam-Webster's Collegiate Dictionary, 1999, Merriam-Webster, Incorporated, 10, 1092.

* cited by examiner

PLASTIC WINDOW ASSEMBLY

The present application is a continuation application of U.S. patent application Ser. No. 09/724,093, filed Nov. 28, 2000, now U.S. Pat. No. 6,606,333.

BACKGROUND OF THE INVENTION

1. Field of the Invention

A plastic window assembly adapted to be mounted in an opening defined by a structure.

2. Description of the Prior Art

A conventional construction method of installing a window into a structure requires the efforts of a skilled tradesman. The skilled tradesman will build an opening to fit the window, and proceed to cut a plurality of mitered pieces to construct the window. This is a time consuming process that is further complicated when a unique shaped window is required. The time required for a skilled tradesman to miter cut pieces for a unique shaped window increases the cost of a window dramatically to the point of being prohibitively expensive for most construction projects.

A low cost easy to assembly and install window is disclosed in the U.S. Pat. No. 5,491,936. The '936 patent discloses an octagonal window assembly adapted to be mounted in an opening of a wall or door. The window assembly comprises a plastic frame supporting parallel spaced window panels. The plastic frame includes a flange. The flange extends from the plastic frame and provides for attachment of the window assembly to the structure. Once the window assembly is mounted to the structure, siding material used to finish the outside of the structure is butted against all sides of the plastic frame. A finish exterior trim ring is provided that attaches to an outside of the plastic frame. The finish exterior trim ring locks onto the plastic frame and over the siding material to provide a finished appearance to the window assembly.

This type of pre-assembled plastic window may include a decorative assembly between the window panes. One type of decorative assembly is a muntin. The muntin provides the look of a wooden window by simulating separated panes of glass. In one type of window assembly, the muntin is disposed between two parallel spaced window panes. Typically, the muntin is fabricated from plastic and has flat sides that abut the window panes. As is appreciated, waviness or irregularities may be contained in the muntin because of the fabrication from plastic. Irregularities or waviness on the flat part of the muntin that abuts the window will cause an unpleasing appearance and destroy the wooden window look desired. Further, the plastic muntin may mar the window panes or leave marks on the window that cannot be removed once the window is assembled.

For these reasons, it is desirable to provide a plastic window assembly that is easy to install, and provides a pleasing decorative appearance without marking or marring the window panes.

SUMMARY OF THE INVENTION AND ADVANTAGES

A plastic window assembly adapted to be mounted in an opening defined by a structure is disclosed. The plastic window assembly includes a plastic frame and parallel spaced window panes supported by the plastic frame. A plastic window muntin is disposed between the window panes and includes a first and second face parallel to the window panes. The window muntin includes a ridge extending upward from one of the faces and contacting one of the window panes.

The plastic window assembly of the subject invention provides for easy low cost installation by providing a pre-assembled window assembly that can be installed into an opening of a structure in reduced time and without skilled craftsman. Further, the plastic window assembly provides for the installation of a plastic muntin between window panes that eliminates marring of the window panes.

BRIEF DESCRIPTION OF THE DRAWINGS

Other advantages of the present invention will be readily appreciated as the same becomes better understood by reference to the following detailed description when considered in connection with the accompanying drawings wherein:

FIG. 10 is a top view of marking on the liner panel;

DETAILED DESCRIPTION OF THE PREFERRED EMBODIMENT

Figure 1:
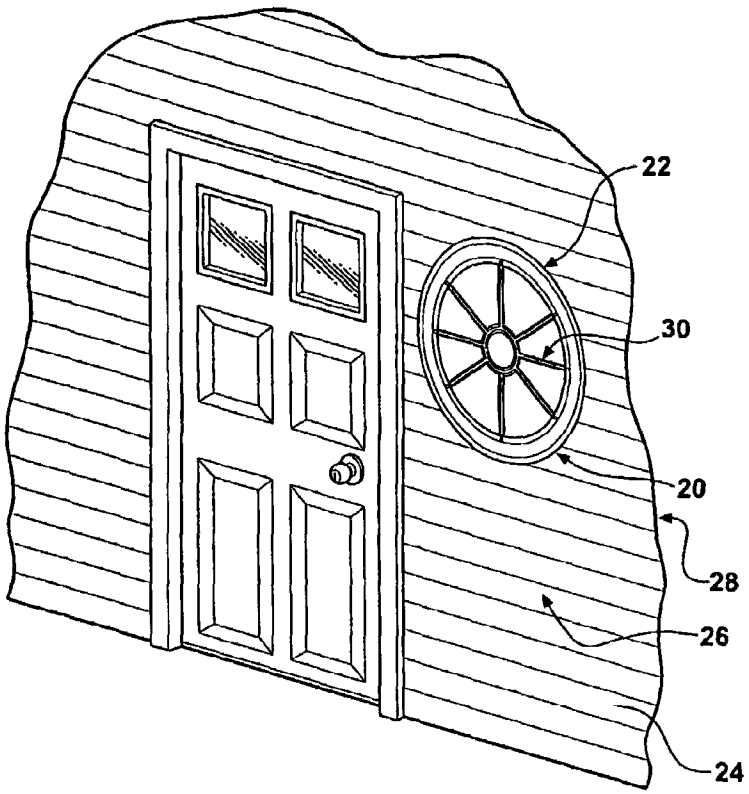
FIG. 1 is a front view of an installed plastic window assembly.

Referring to the Figures, wherein like numerals indicate like or corresponding parts throughout the several views, a plastic window assembly is generally indicated at 20. Referring to FIG. 1, the plastic window assembly 20 is adapted to be mounted in an opening 22 defined by a structure 24. The structure 24 has exterior and interior surfaces 26 and 28. The plastic window assembly 20 may be installed in any desired location within the structure 24.

Figure 2:
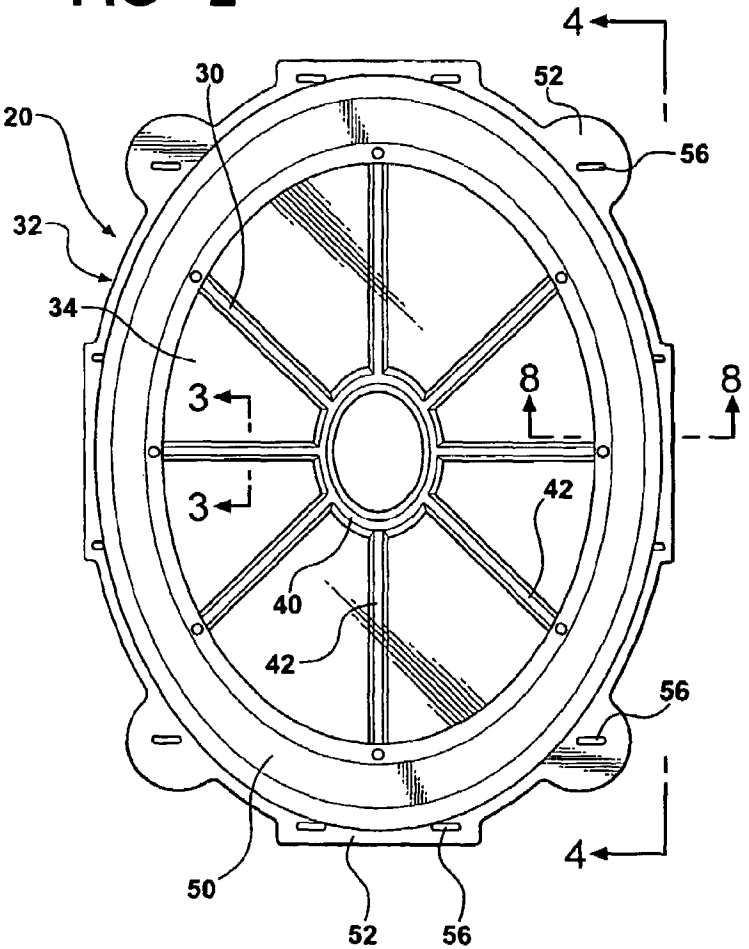
FIG. 2 is a front view of the plastic window assembly.

Referring to FIG. 2, the plastic window assembly 20 is oval shaped with a decorative plastic window muntin 30. Although the preferred embodiment is oval shaped, the plastic window may be shaped in any continuous curvilinear form. Further the plastic window assembly may also be annular in shape. The plastic window assembly 20 includes a plastic frame 32 that supports parallel window panes 34. The window muntin 30 is disposed between the parallel window panes. The window muntin 30 includes a central portion 40 and a plurality of bars 42. The plurality of bars 42 extend radially from the central portion 40 to the plastic frame 32. The central portion 40 of the preferred embodiment is oval shaped to coincide with the oval shaped plastic frame 32. As appreciated, the central portion 40 may include any continuous curvilinear shape. Further the central portion 40 may also be annular shaped to conform to the shape of the plastic window assembly 20. Although the preferred embodiment is oval shaped it should be understood that any shape curvilinear window is within the contemplation of this invention.

Figure 3:
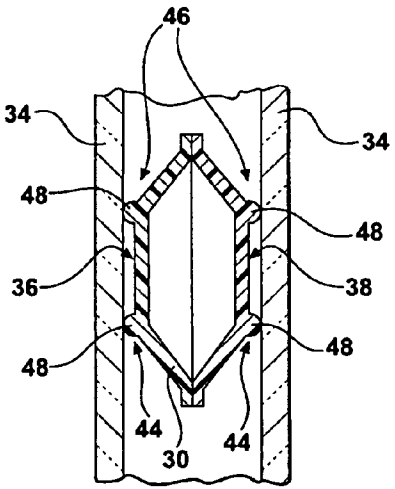
FIG. 3 is a cross-sectional view of the plastic window muntin.

Referring to FIG. 3, the window muntin includes a first face 36 and second face 38 parallel to the window panes 34. The first and second faces 36 and 38 of the window muntin 30 are flat surfaces parallel to the window panes 34. Each of the faces 36, 38 have a first edge 44 and a second edge 46 and include a ridge 48 disposed along each of the edges 44 and 46. The ridge 48 extends upward from at least one of the faces 36, 38 and contacts at least one of the window panes 34. By contacting the window panes 34 with the ridge 48 instead of the entire first and second face 36 and 38, marring of the window panes 34 is prevented. Marring is prevented because the ridge 48 provides for line contact between the window muntin 30 and the window panes 34.

The line contact between the ridge 48 and the window panes 34 also provides for more uniform contact between the window muntin 30 and the window panes 34 compared to contact with the flat faces 36 and 38 of the window muntin 30. Further, the line contact improves the appearance of the window muntin 30 by accommodating production variation in the window muntin 30. Without the ridge 48, irregularities in the window muntin 30 would be seen as voids between the window panes 34 and the faces 36 and 38 and would detract from the appearance of the window assembly 20. The line contact provided by the ridge 48 accommodates the production variation to provide for uniform contact between the window muntin 30 and the window pane 34.

Figure 4:
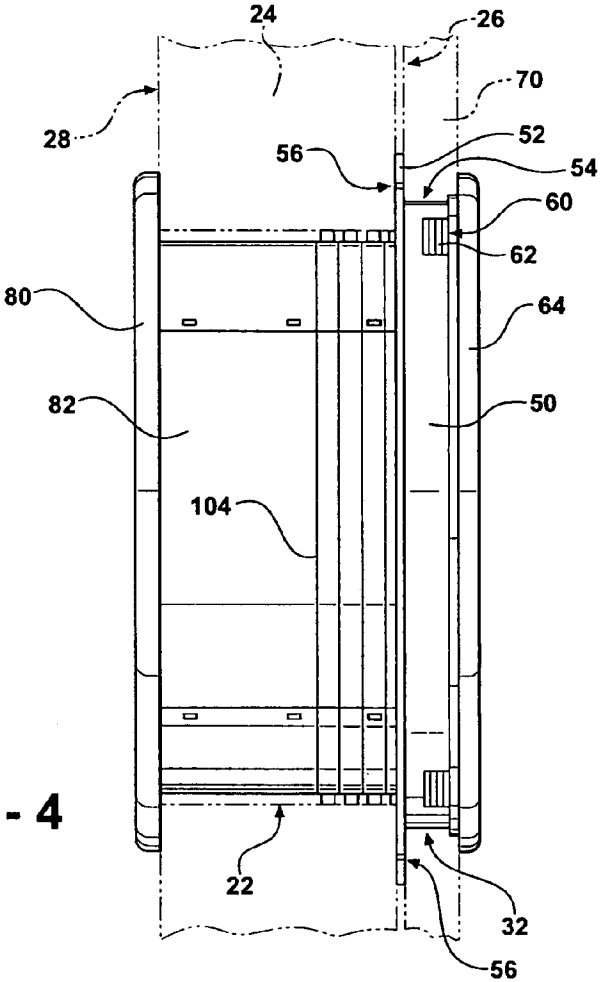
FIG. 4 is a side view of fully assembled plastic window assembly
Figure 5:
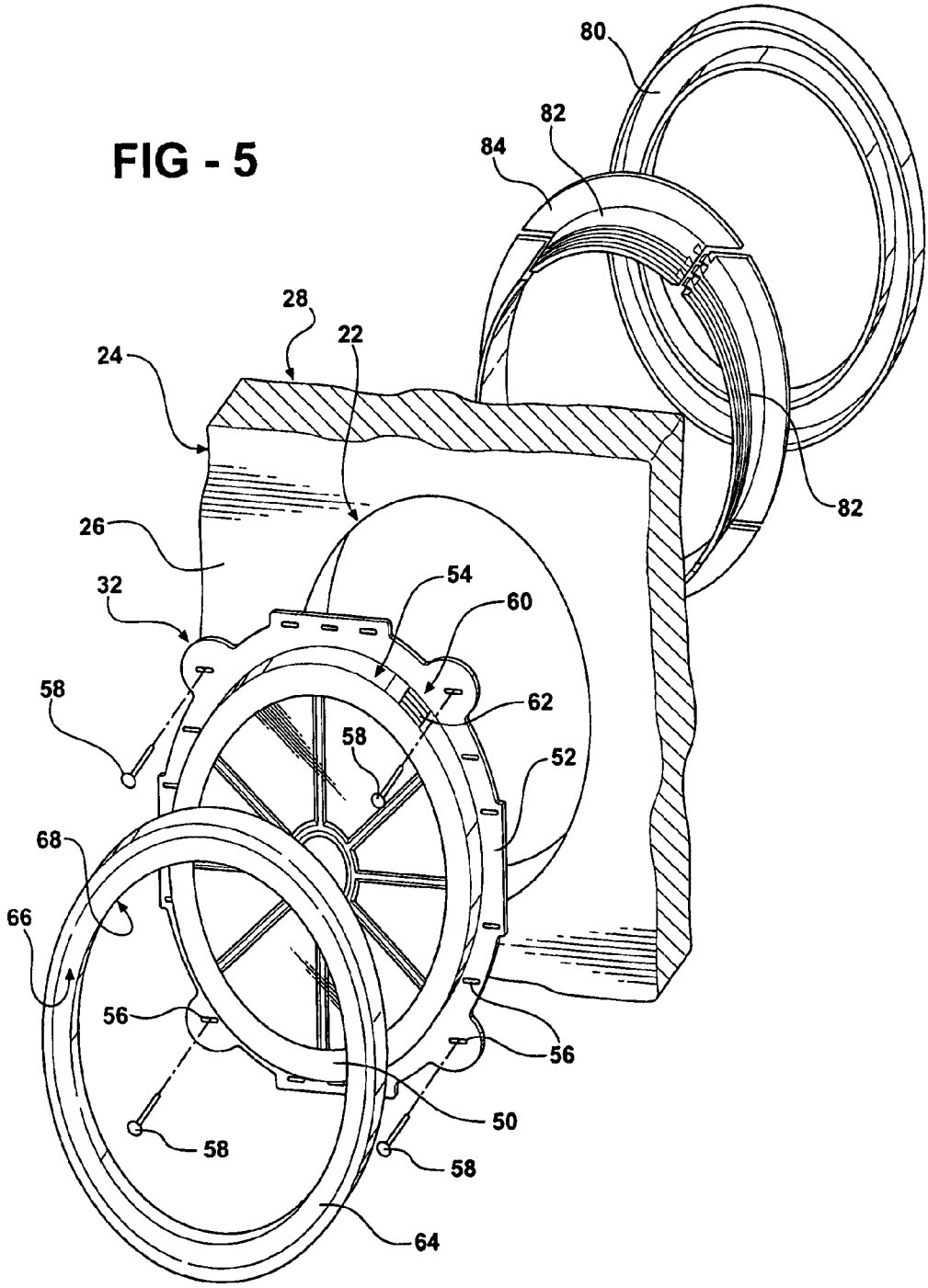
FIG. 5 is an exploded view of the plastic window assembly.

Referring to FIGS. 4 and 5, the plastic frame 32 includes an outer housing 50. A flange 52 extends from the outer housing 50 and about a periphery 54 of the outer housing 50. The flange 52 includes apertures 56 disposed at various locations about the outer housing 50. Mounting fasteners 58 such as nails, screws or the like are inserted through the apertures 56 to secure the window assembly 20 to the structure 24.

The outer housing 50 includes at least one section having a plurality of teeth 60 disposed about the periphery 54 of the outer housing 50. An exterior plastic trim ring 64 having an inner surface 66 with a least one tab 68 engages the teeth 62 to lock onto the outer housing 50 of the window frame 32. The exterior trim ring 64 telescopingly fits onto the outer housing 50 of the window frame 20. The distance that the exterior trim ring 64 fits onto the outer housing 50 varies depending on the installation. The adjustability of the exterior trim ring 64 is provided to accommodate various thickness of siding materials 70. After the plastic frame 32 secured to the exterior of the structure 26, siding material 70 will by butted up against the plastic frame 32 about its entire periphery 54. Butting the siding against the plastic frame 32 covers up the unappealing fasteners 58 used to mount the plastic frame 32. The exterior trim ring 64 is than inserted over the outer housing 50 and pushed against the siding 70 and thereby provides a finished appearance to the exterior side of the window assembly 20.

Figure 6:
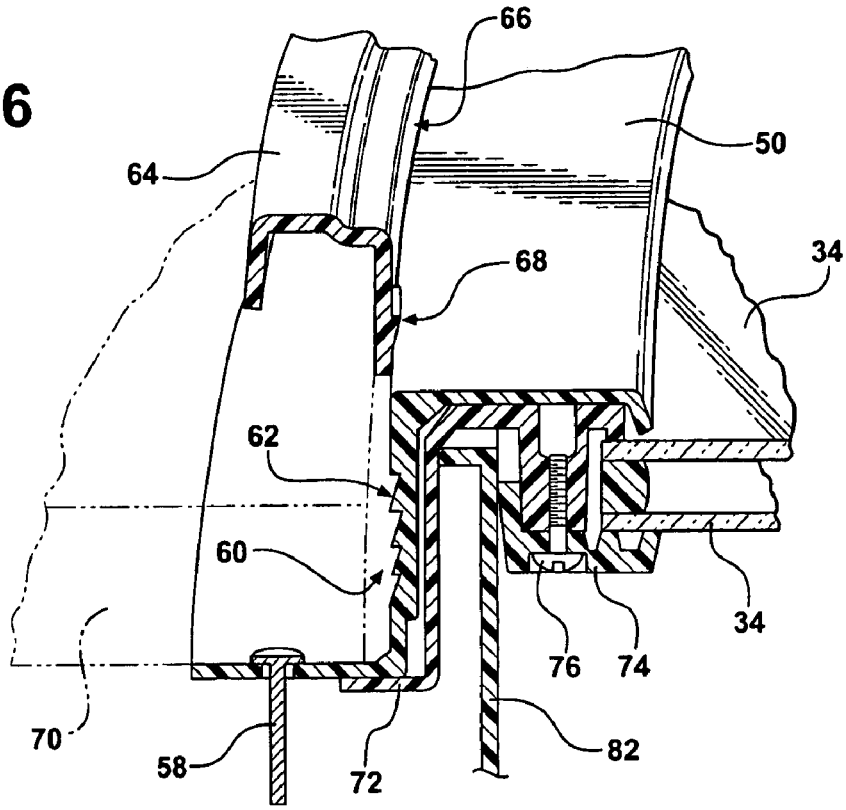
FIG. 6 is a cross-sectional view of the exterior trim ring and the outer housing;.
Figure 7:
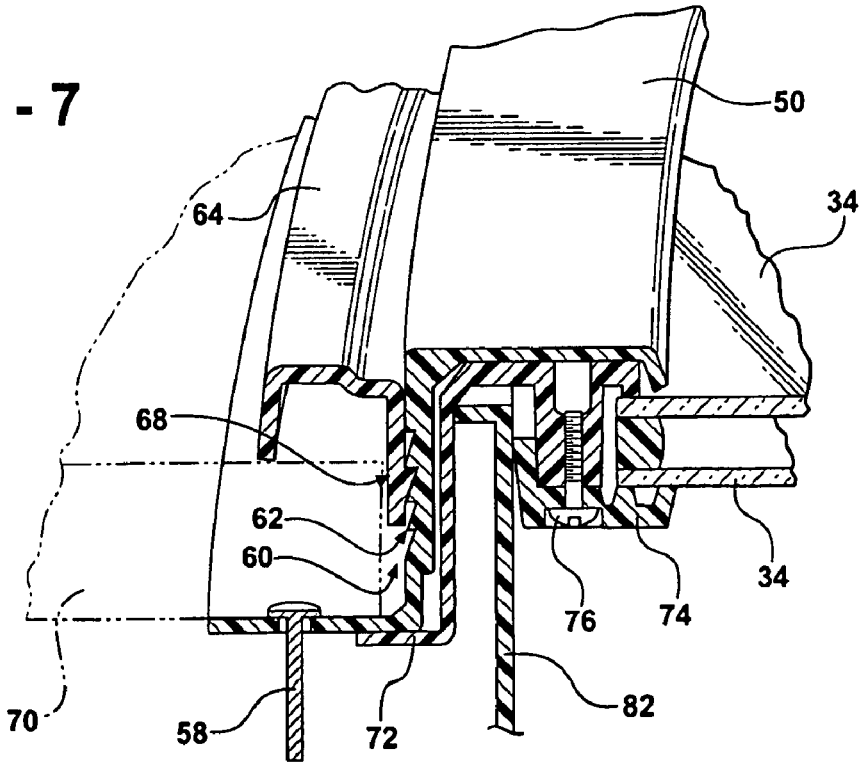
FIG. 7 is a cross-sectional view of the exterior trim ring attached to the plastic frame.

Referring to FIGS. 6 and 7, the tabs 68 of the exterior trim ring 64 are disposed at discrete locations about the inner surface 66 of the exterior trim ring 64. Each tab 68 cooperates with the teeth 60 disposed about the periphery of the outer housing 54. Preferably, there are a plurality of teeth 62 at each discrete location 60 to allow the depth that the exterior trim ring 64 is inserted onto the outer housing 50 to vary in order to accommodate common types of siding 70.

Figure 8:
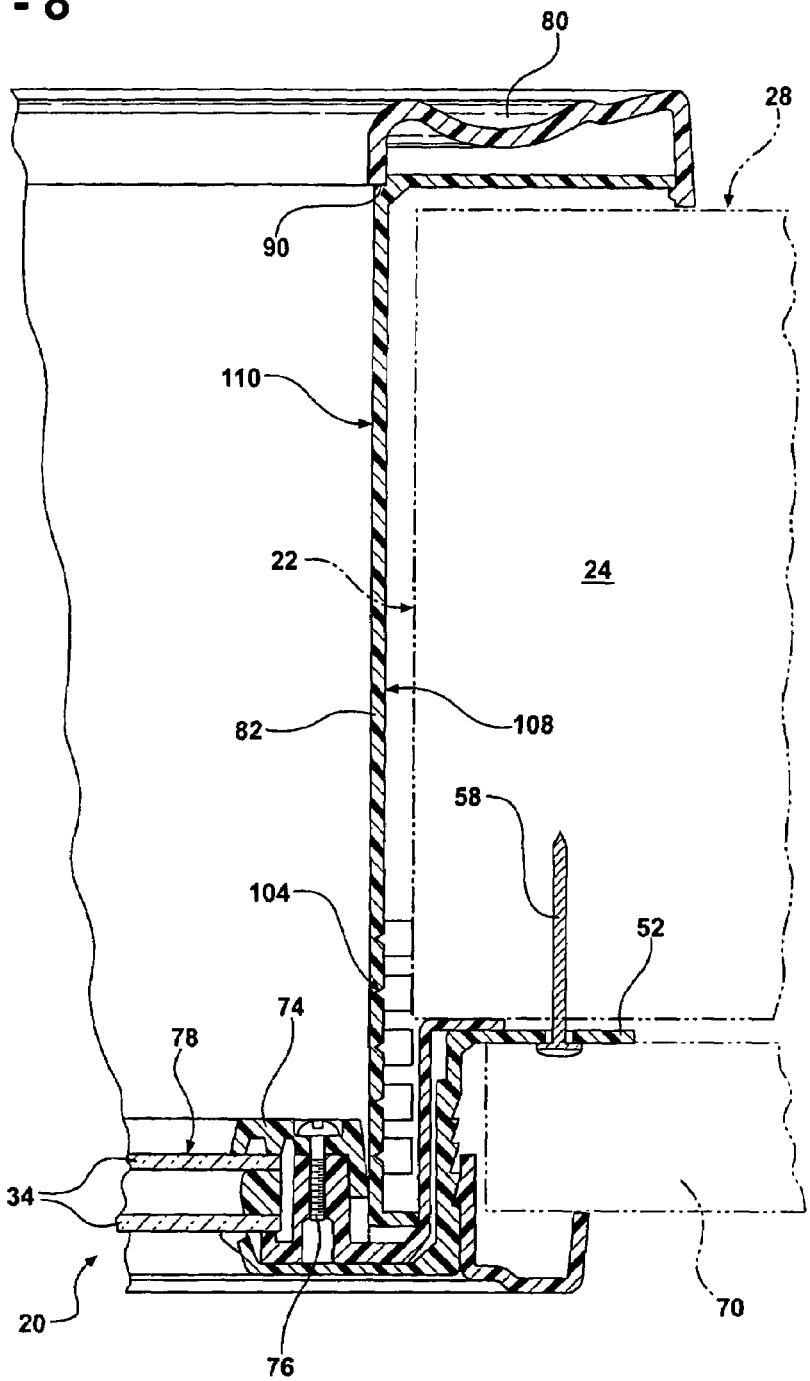
FIG. 8 is a cross-sectional view of a fully installed plastic window assembly.

Referring to FIG. 8 the plastic frame 32 also includes an inner housing 72 and a housing ring 74. The outer housing 50 supports a first side of the parallel window panes 34. The inner housing 72 is attached to an inner side of the outer housing 50. The inner housing 72 also supports the parallel window panes 34 and provides for the sealing of the space disposed between the window panes 34. The housing ring 74 attaches to the inner housing 72 with a plurality of threaded fasteners 76. The inner housing ring 74 abuts against an inside surface 78 of the window pane 34 to provide a finished appearance.

The window assembly 20 also includes an interior plastic trim ring 80, and a plurality of liner panels 82. The liner panels 82 are provided in several interlocking pieces that are locked together during installation. The liner panels 82 extend from the interior surface 28 of the structure 24 through the provided opening 22 and into the plastic frame 32. The interior trim ring 80 attaches to the flange 84 of the liner panels 82 The liner panels 82 have a first end 88 adapted for insertion into the plastic frame 32. More specifically each liner panel 82 is locked into the inner housing 72. The liner panels 82 also include a second end 86 having a flange 84 for abutting against the interior surface 28 of the structure 24 defining the opening 22. The interior plastic trim ring 80 attaches the flange 84. The liner flange 84 includes a recess 90 for the attachment of the interior trim ring 80. The liner flange 84 also includes an aperture 92 through which a fastener is inserted to secure liner panel 82 to the interior surface 28 of the structure 24.

Figure 9:
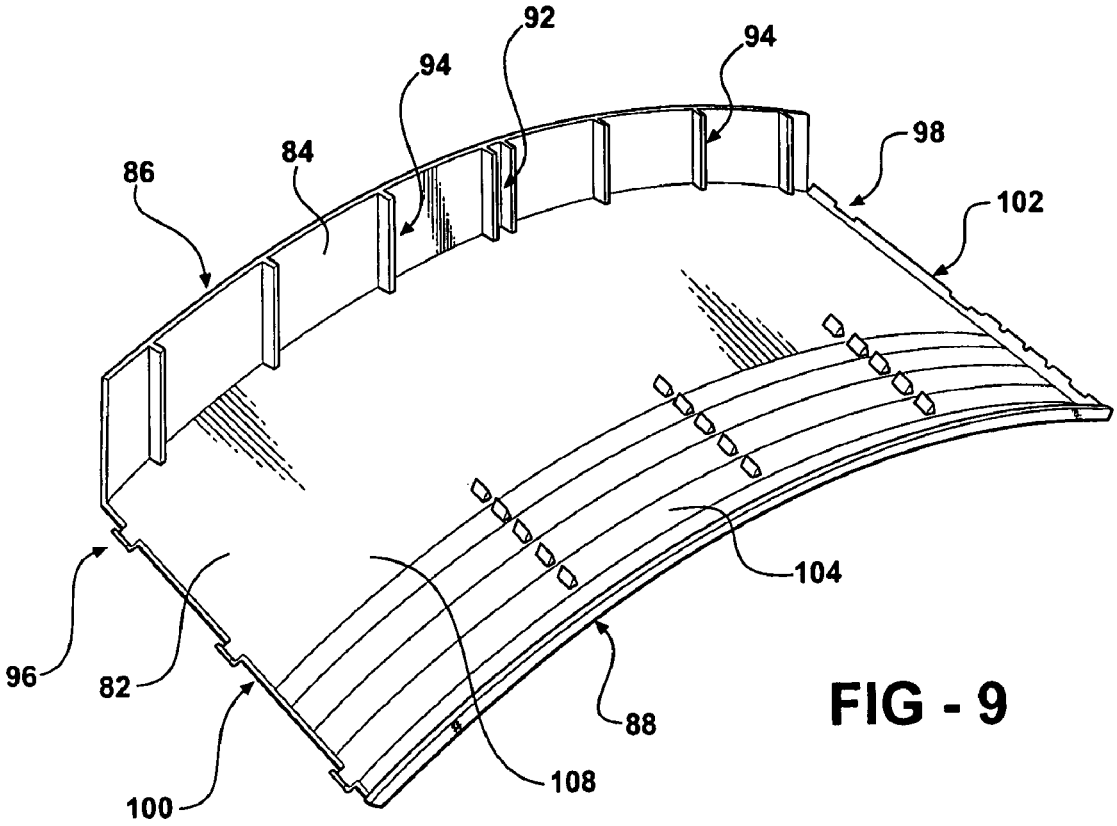
FIG. 9 is a perspective view of a liner panel.

Referring to FIG. 9, each of the liner flanges 84 include a plurality of ribs 94. The ribs 94 provide for the spacing of the liner flange 84 from the interior surface 28 of the structure 24 defining the opening 22. The ribs 94 space the liner flange 84 a predetermined distance from the interior surface 28 of the structure 24. Proper spacing is required such that the interior trim ring 80 will properly mate to the liner flange 84.

Figure 10A:
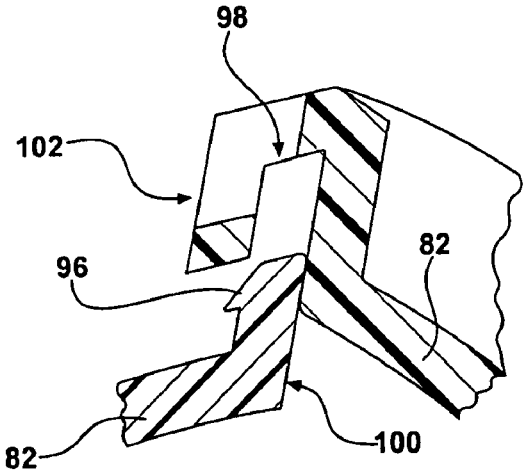
FIG. 10A is a sectional view of the locking tab and slot of the liner panel.
Figure 10B:
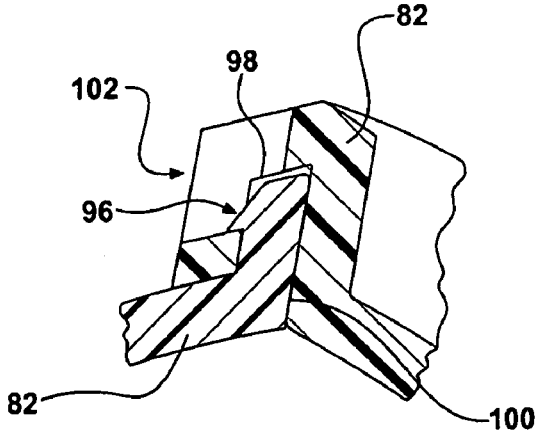
FIG. 10B is a sectional view of the locking tab locked within the slot of another liner panel.

The liner panels also include a first edge 100 and a second edge 102 transverse to the ends 86 and 88. Each of the liner panels 82 includes a hook 96 and a slot 98. The first edge 100 includes the locking hook 96 and the second edge 102 includes a slot 98 for lockingly engaging the hook 96. In a completely assembled window assembly 20 each of the liner panels 82 are interlocked to an adjacent liner panel 82. The hook 96 and slots 98 are disposed at opposing ends of each liner panel 82. The liner panels 82 form an oval when interlocked. Preferably, there are four liner panels 82 to construct the oval shape required to mate with the oval plastic frame 32. Referring to FIGS. 10A and 10B, the hook 96 of each liner panel 82 locks into the slot 98 of an adjacent liner panel 82. The hooks 96 and slots 98 of the liner panels 82 may be assembled without the using any tools.

Figure 11:
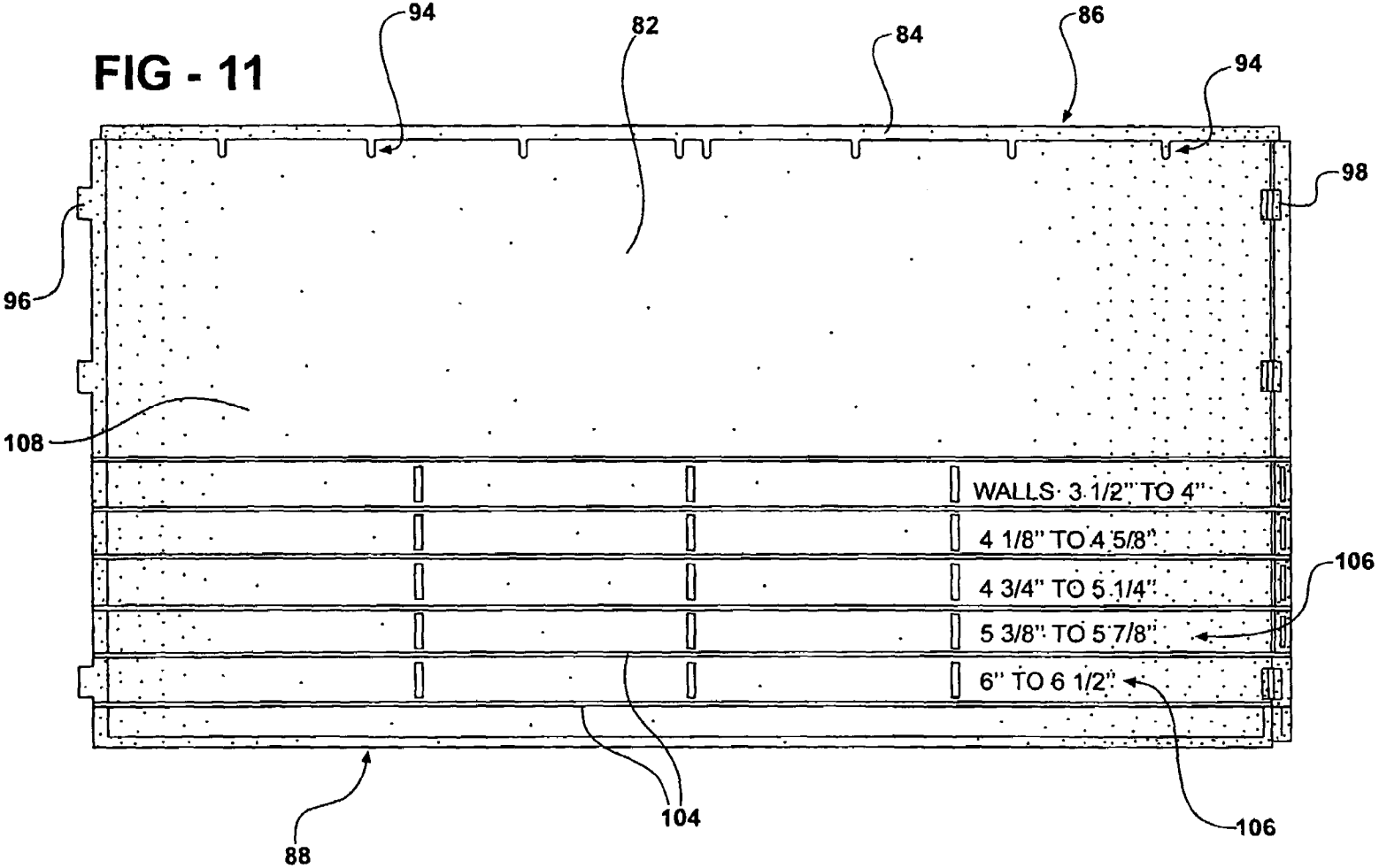
FIG. 11 is a top view of the liner panel.

Referring back to FIG. 9, each liner panel 82 includes a plurality of serrations 104. The serrations 104 are provided such that the length of the liner panel 82 may be cut to accommodate various thickness of openings 22. Referring to FIG. 11, each of the liner panels 82 include a plurality of markings 106 indicating which serration 104 on the liner panel 82 is to be cut to accommodate specific widths of the opening 22. The liner panels 82 have an outer side 108 and an inner side 110, the outer side 108 includes the markings 106. The inner side 110 of the liner panel 82 includes a surface texture 112 simulating wood grain.

Figure 12:
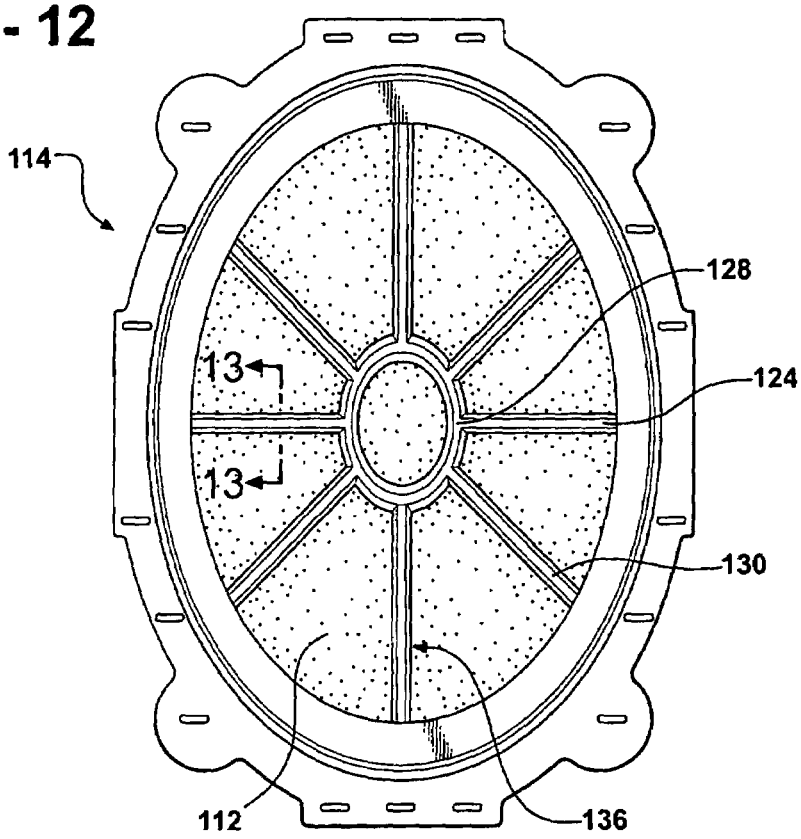
FIG. 12 is a front view of an alternate embodiment of the plastic window assembly.

Referring to FIG. 12, an alternate embodiment of a plastic window assembly is generally indicated at 114. The alternate window assembly 114 includes a plastic pane 116 disposed between the parallel spaced windowpanes 34. Preferably, the plastic windowpane 116 includes a surface texture 112 simulating frosted glass. The surface texture 112 is created by molding the plastic windowpane with a mold having a texture surface. The surface texture 112 that simulates the frosted glass includes a plurality of randomly arranged indentations 138. The plastic pane 116 has a front side 120 and a backside 122. The plastic pane 116 includes an integrally molded window muntin 124. The front side 120 of the integrally molded window muntin 124 includes a first edge 132 and a second edge 134 and a ridge 126 extending upward therefrom. On the first side 132 is a decorative coating 130 to simulate the bars that would hold panes of glass in a genuine frosted window. The plastic window pane 116 of the alternate window assembly 114 has a center portion 128. Bars 136 extend from the center portion 128 to the outer housing plastic frame 32

Figure 13:
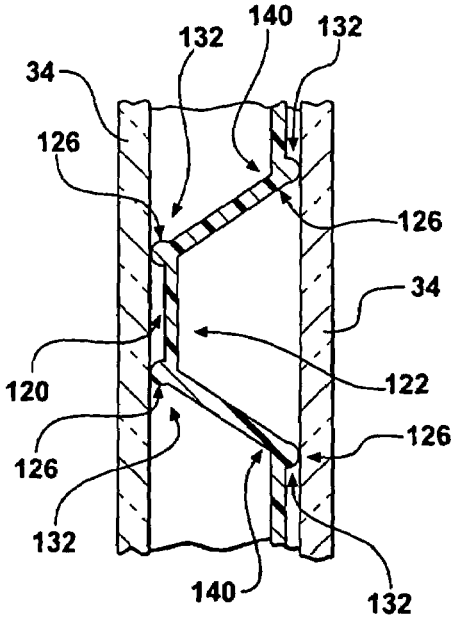
FIG. 13 is a cross-sectional view of the plastic pane of the alternate embodiment.

Referring to FIG. 13, the plastic window muntin 124 is integrally formed with the plastic windowpane 116. The ridges 126 are formed on each side of the window muntin 124. The first side 120 of the plastic window muntin 124 is further defined as a flat surface parallel to the windowpanes 34. Each side 120, 122 has a first edge 132 and a second edge 134 and the ridge 126 is disposed along each of the edges 132,134. The integrally formed window muntin 124 is clear while the simulated panes of glass are textured to simulate frosted glass. Ridges 126 on the second side 122 of the window muntin 124 are disposed at a point of intersection 140 between the simulated frosted glass 112 and the window muntin 124.

Obviously, many modifications and variations of the present invention are possible in light of the above teachings. The invention may be practiced otherwise than as specifically described within the scope of the appended claims.

What is claimed is:

1. A plastic window assembly adapted to be mounted in an opening defined by a structure, said assembly comprising:

a plastic frame, parallel spaced window panes supported by said plastic frame and a plastic window muntin disposed between said window panes and including a first and second face parallel to said window panes, said plastic window muntin having a first end and a second end, at least a portion of said plastic window muntin being visible through at least one of said window panes for providing the look of a wooden window by simulating separated window panes, said window muntin including a ridge extending upward from one of said faces and contacting one of said window panes.

2. An assembly as set forth in claim 1 wherein said first and second faces of said window muntin are further defined as flat surfaces parallel to said window panes, said flat surfaces have a first edge and a second edge and include one of said ridges disposed along each of said edges.

3. An assembly as set fourth in claim 2 wherein said window muntin includes a central portion and a plurality of bars, said plurality of bars extending radially from said central portion to said plastic frame and said ridge extends completely around said central portion.

4. An assembly as set forth in claim 3 wherein said plastic window frame is shaped with a periphery having a continuous curvilinear shape and said central portion of said plastic window muntin also includes a periphery having a continuous curvilinear shape.

5. An assembly as set forth in claim 3 wherein said plastic window frame is shaped with a periphery having an annular shape and said central portion of said plastic window muntin also includes a periphery having an annular shape.

6. An assembly as set forth in claim 3 wherein said plastic window frame is oval-shaped and said central portion of said plastic window muntin also oval-shaped.

7. An assembly as set forth in claim 1 further including a plastic windowpane disposed between said parallel spaced windowpanes.

8. A plastic window assembly, as set forth in claim 1, the ridge preventing the one of said faces from contacting a corresponding window pane.

9. A plastic window assembly adapted to be mounted in an opening defined by a structure, said assembly comprising:

a plastic frame;

a pair of parallel spaced window panes supported by said plastic frame; and a plastic window muntin for providing the look of a wooden window by simulating separated window panes and being disposed between said window panes and including a first and second face parallel to said window panes, said window muntin including a ridge extending upward from one of said faces and contacting one of said window panes, wherein said first and second faces of said window muntin are further defined as flat surfaces parallel to said window panes, wherein said flat surfaces have a first edge and a second edge and include one of said ridges disposed along each of said edges, said window muntin extending from one edge of the plastic frame to another edge of the plastic frame.

10. A plastic window assembly, as set forth in claim 9, said plastic window muntin having a first end and a second end, at least a portion of said plastic window muntin being visible through at least one of said window panes.

11. A plastic window assembly, as set forth in claim 9, the ridge preventing the one of said faces from contacting a corresponding window pane.

12. A plastic window assembly adapted to be mounted in an opening defined by a structure, said assembly comprising:

a plastic frame;

a pair of parallel spaced window panes supported by said plastic frame; and a plastic window muntin for providing the look of a wooden window by simulating separated window panes and being disposed between said window panes and including a first and second face parallel to said window panes, said window muntin including a ridge extending upward from one of said faces and contacting one of said window panes, wherein said first and second faces of said window muntin are further defined as flat surfaces parallel to said window panes, wherein said flat surfaces have a first edge and a second edge and include one of said ridges disposed along each of said edges, said window muntin including a plurality of bars, at least one of said bars extending from an edge of the plastic frame.

13. A plastic window assembly, as set forth in claim 12, said plastic window muntin having a first end and a second end, at least a portion of said plastic window muntin being visible through at least one of said window panes.

14. A plastic window assembly, as set forth in claim 12, the ridge preventing the one of said faces from contacting a corresponding window pane.

* * * * *